US005890223A

United States Patent [19]

Klemmer

[11] Patent Number: 5,890,223

[45] Date of Patent: Apr. 6, 1999

[54] CHILD'S FEEDING IMPLEMENT

[76] Inventor: Kelly Klemmer, 1417 Spencer Ave., Apt. D, New Bern, N.C. 28560

[21] Appl. No.: 899,352

[22] Filed: Jul. 23, 1997

[51] Int. Cl.[6] ..... A47J 43/28

[52] U.S. Cl. ..... 30/150; 30/323; 30/326

[58] Field of Search ..... 30/322–324, 326, 30/147, 150, 148, 149

[56] References Cited

U.S. PATENT DOCUMENTS

| | | | |
|---|---|---|---|
| D. 143,047 | 11/1945 | Storm | 30/324 |
| D. 146,824 | 5/1947 | Goodwin | 54/12 |
| D. 184,944 | 4/1959 | Kaye | 54/12 |
| D. 281,135 | 10/1985 | Jagger | 7/150 |
| D. 294,553 | 3/1988 | Jagger | 7/141 |
| 2,607,988 | 8/1952 | Williams | 30/322 |
| 2,787,055 | 4/1957 | Wertz | 30/324 X |
| 3,014,277 | 12/1961 | Geckler | 30/324 |
| 4,389,777 | 6/1983 | Landsberger | 30/324 |
| 5,479,708 | 1/1996 | Thomas | 30/322 X |

OTHER PUBLICATIONS

Product Catalog, p. 15.
Product Catalog, pp. 270–271, 273, 275.
Flaghouse Catalog, p. 80,82.

*Primary Examiner*—Douglas D. Watts
*Attorney, Agent, or Firm*—JoAnne Denison; Demson & Assocs, P

[57] ABSTRACT

The present invention consists of an angled disabled and/or young child's feeding implement which has a handle portion which is bent from the longitudinal axis of the implement by approximately fifteen to seventy degrees. In one preferred embodiment of the invention, the feeding element portion has either a spoon bowl portion or a fork tine portion which is provided with a threaded fastening element extending therefrom. The corresponding handle portion contains the desired bend and further contains a corresponding threaded aperture which is adapted to removably secure the threaded fastening element of the feeding element portion so that fork tines, spoon bowls and a variety of handle portions of slim, medium and thick dimensions may be readily interchanged to suit the development, size and capabilities of the child. A flanged annulus may be further provided as a mouth guard to prevent choking.

12 Claims, 2 Drawing Sheets

CHILD'S FEEDING IMPLEMENT

FIELD OF THE INVENTION

The present invention relates to the field of infant feeding implements designed for very young children and/or those with disabilities, and more particularly feeding implements which are bent or angled and which have interchangeable feeding elements and handle portions and mouth guards which may be tailored to suit the needs of children who experience difficulty in feeding themselves such that the mere action of placing the child's hand on a feeding implement and then bringing the feeding implement to the child's mouth is not well done, or only done with great difficulties.

BACKGROUND OF THE INVENTION

Currently there is a great need for improved feeding implements either for the child which is so young that the child is just learning to feed herself or himself, or a feeding implement which can meet the needs of an impaired child. It is especially important to provide for a left handed feeding implement nearly as often as a right handed feeding implement, since it is shown that although 10% of the normal population is typically left handed, approximately 40% of the mentally impaired population is left handed. Often where mental impairment is found, damage on the left side of the brain results in right extremity involvement, leaving an individual with a left handed preference. Thus, a feeding implement well suited to left handed individuals is found to be highly lacking in the marketplace.

Although there are many feeding implements in the marketplace which have built up or thickened grip portions, most of these are of a highly irregular curved shape, or they are a simple straight cylinder. To date, nowhere in the market may be found a built up feeding implement which is most particularly well suited to making a child's grip more comfortable and natural feeling.

Also, it is seen in the marketplace that most children's feeding implements have little or no method for assisting the child to select a proper grip in the center of the hand portion. One device disclosed in U.S. Des. No. 146,824 issued to J. L. Goodwin is a bent spoon with a mouth guard. However, the mouth guard employed consists of only slightly flaring horizontal wings. It promotes hand placement to a point, but it does little to prevent the child from placing the feeding element too far back in the throat, inducing the choking reflex. Moreover, the flaring wings are permanent and not removable.

Another device disclosed in the prior art is U.S. Pat. No. 4,563,816 issued to V. D. Jagger which illustrates the use of a highly irregularly configured bent children's feeding spoon. However, this device has no grip guide/mouth guard to promote proper finger placement and prevent the device from entering too far back into the child's mouth.

An example of a built up handle may be found in U.S. Pat. No. 4,389,777 issued to D. Landsberger in which is disclosed a straight spoon with a thick cylindrical handle which is weighted in its interior. However, this device does not make a grip more comfortable, nor does it provide a grip guide/mouth guard to promote proper finger placement and prevent the device from entering too far back into the child's mouth. It is also straight instead of bent to an angle and furthermore, the handle is of only one size.

With regard to the marketplace, there are typically present feeding implements made either entirely from metal or they are made with a metal feeding implement portion and a plastic handle or grip portion, making them very costly. In fact, feeding sets for the disabled can run as high as $50 to $195, making them very difficult for the average family to afford, let alone a family with a disabled child who typically experiences much higher than average medical expenses. It is rare to find an implement made entirely from plastic at an economical cost of less than $10.

Thus, nowhere in the prior is seen a young or disabled child's feeding implement which is bent, has a built up gripping portion with finger indentations, is of a raised oval configuration for improved grip feel, has a removable or permanent mouth guard consisting of an annular flange which also promotes proper finger grip while at the same time preventing the feeding implement from being placed too far back into the child's throat and which may be used by either left handed or right handed children. Further, there are no devices seen in the prior art which have interchangeable handles which can be used by either left handed or right handed individuals or those that switch, depending on the type of food offered. As well, there are no devices seen in the prior art wherein the feeding element portion, typically a spoon bowl or fork tines, may be changed to suit the child's needs as she or he grows or matures or becomes weakened with a particular affliction. And, often many specialized feeding implements for young children or the impaired child are made from metal or have metal components, making them very costly.

SUMMARY OF THE INVENTION

The present invention consists of an improved young or disabled child's feeding implement which is bent at an angle typically from 15° to 50° which allows the feeding implement to be brought to the mouth and placed therein with minimal effort. The efficacy of bent children's feeding implements are well known within the art as assisting the very young and/or disabled child. In one embodiment of the invention, the feeding implement is outfitted with a mouth guard consisting of a flanged annulus placed directly between the feeding implement portion and the handle or grip portion. This mouth guard may be made from plastic or other co-polymer which is either integral to the feeding implement or which may be made as a snap on removable attachment for flexibility in use.

It is also well noted in the prior art that various sizes and configurations of built up handles make self feeding of a young and/or disabled child easier. However, nowhere in the prior art is shown a device wherein a variety of configurations of handles, slim, medium and thick, bent and not bent, with gripping indentations and without gripping indentations may be used on interchangeable feeding element portions. In one embodiment of the invention, a feeding element portion is provided with a tapered or straight thread portion such that it may be used with a variety of types of handles. Some children may need different handles depending on the type of food, while others may need to change handles depending on whether they are having a good day and their grip is strong, or if they are having a poor day and their grip is weakened such that they could benefit from a feeding implement with a built up handle or gripping portion. While some children are growing and maturing, others are weakening due to illness. The present invention is well adapted to such situations and solves this problem in the art by providing a variety of handle or gripping portions with various shapes, weights, sizes and degrees of bending which could be sold in a set. Oftentimes parents will purchase a particular feeding implement set, only to find out that the grip needs to be either thicker or thinner for the child, making the parent return the entire set or exchange it. The present invention solves this dilemma by providing for an interchangeable handle portion.

Likewise, it is anticipated that the feeding implement portion of the feeding set may provide several different feeding element portions. For instance, some children may at times need a narrower spoon bowl portion when they are younger and then a larger more standard spoon bowl portion as they grow and mature. They may also need a shallower spoon bowl portion when younger for easier placement and removal of food on the spoon bowl. But as they mature, the spoon bowl may be deepened to hold more food. Further, it may be helpful with a younger child or a more impaired child to have more blunt fork tines to prevent self injury, whereas an older child may enjoy piercing food with sharper fork tines. Thus, several different sets of spoon and fork feeding implement portions may be included in a complete feeding set. Or sets may be provided for the younger child or impaired child with thicker gripping handles and mouth guards and greater bend angles between the handle and feeding element, whereas an older child may need less bend angle, larger sharper fork tines and deeper spoon bowls and slimmer handles.

In yet another embodiment of the invention, the handle portion is build up with an oval grip portion with finger indentations. This provides for a very comfortable grip which should induce the child to enjoy holding and using the device. A built up handle accomodates either a fisted hand or a hand with poor muscle strength that is unable to maintain a refind grasp.

It is further anticipated that the feeding implement is to be made from a plastic or other co-polymer for lightness, safety and economy. In such a manner, the improved feeding implement can be made affordable for a family even on a very modest budget. Making the implement from plastic instead of metal is often helpful to the disabled and/or very young child who pokes the implement into the mouth with decreased accuracy wherein metal may be more injurious to sensitive gum and mouth tissues.

OBJECTS OF THE INVENTION

Thus, it is one primary object of the instant invention to provide an improved young child/disabled child's feeding implement having a removable bent handle portion which may curve to either the left or right, as it is desired by the health care professional or child caretaker depending upon the left handed or right handed tendencies of the child.

It is an additional primary object of the instant invention to provide an improved young child/disabled child's feeding implement having a removable bent handle portion wherein the feeding implement portion further is equipped with a threaded element which is adapted to fit into and be secured by a handle portion.

It is further a primary object of the instant invention to provide an improved young child/disabled child's feeding implement having a removable bent handle portion wherein the entire device is made from a plastic or other co-polymer for economy of manufacture and to prevent injury to a child's mouth.

It is further a primary object of the present invention to provide an improved young child/disabled child's feeding implement having a removable bent handle portion which grip or handle portion may be made from a variety of configurations such as slim, medium or thick, bent, slightly bent or non-bent, handles with finger indentations or without indentations that can be used so that a parent can purchase a complete set of fork and spoon elements with a variety of handle or grip portions to suit the child at particular stages of development and/or not need to return or exchange the device if a different size or type of handle configuration is desired or necessary.

It is further a primary object of the present invention to provide an improved young child/disabled child's feeding implement having a removable bent handle portion wherein different feeding implements with either narrower or wider spoon bowls, deeper or more shallow spoon bowls, or forks with blunter tines to prevent injury may be readily interchanged in a complete feeding set.

It is still a further primary object of the present invention to provide an improved young child/disabled child's feeding implement having either a permanent, integral or a removable snap on flanged annulus which promotes not only proper positioning of the child's hand on the grip portion of the device, but more importantly, to provide a mouth guard which prevents the child from placing the device too far back into the mouth, invoking a choking reflex.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
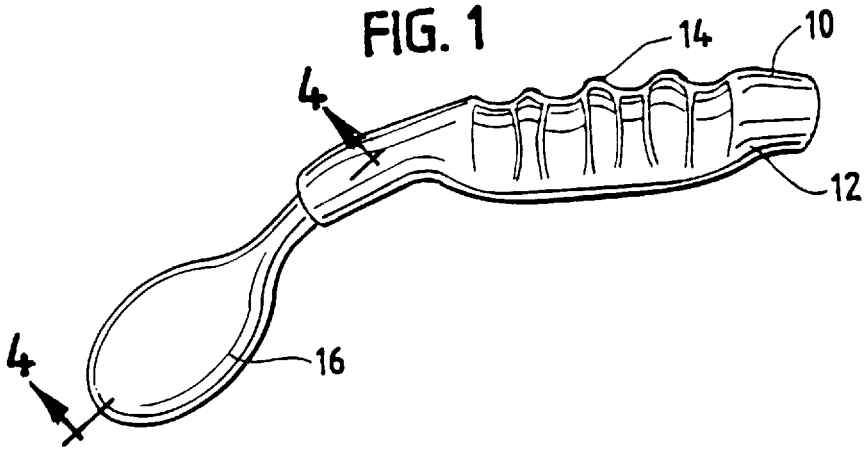
FIG. 1 is a top view of the present invention with a thick handle portion having a bend of approximately 45° with a removable handle portion having indentations in its distal side portion.
Figure 2:
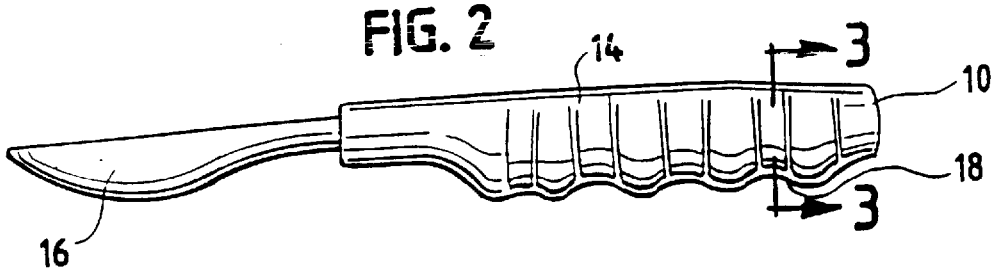
FIG. 2 is a side view of the present invention showing a thick handle portion with indentations also present in the bottom or underside of the handle portion.
Figure 3:
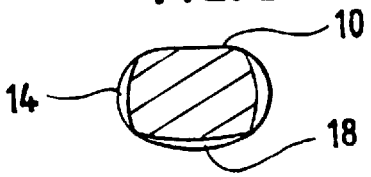
FIG. 3 is an elevated cross section of the handle portion of the present invention taken along line B—B of FIG. 2.

Shown in FIG. 1 is a top view of a first embodiment of the present invention, improved child's feeding implement 10. This particular embodiment shows a thick handle portion of approximately 0.9" to 1.2" in diameter at its widest point for children with a limited grip or limited mobility or for older children. The handle portion tapers at either end and is oval in cross section (as shown in FIG. 3) for improved comfort in grip to induce the child to hold and use improved feeding implement 10. In this view are shown side finger indentations 14; however, bottom finger indentations 18 are also provided, as shown in FIG. 2, for improved comfort. Thus, with finger indentations in both the distal side of thick handle portion 12 and the bottom or underside of thick handle portion 12, the handle would be most comfortable to grip and use. The presence of finger indentations 12 and 14 also make proper handle positioning easier for the very young or impaired child.

Preferably, thick handle portion 12 is made from plastic or another co-polymer for economy. Shallow spoon bowl portion 16 may be made from stainless steel either for durability or when a child has a strong bite reflex such that she or he would destroy ordinary plastic. The depth of a typical shallow spoon bowl is from 0.2" to 0.3". In this particular first embodiment of the invention is shown a shallow spoon bowl which makes it easier for the very young child or impaired child to remove food from the spoon since less lip closure is required.

FIG. 2 shows a side view of improved child's feeding implement 10 wherein the shallow depth of shallow spoon bowl 16 is readily viewed in this profile. Further bottom or underside finger indentions 18 are also readily viewed in profile in this view.

FIG. 3 shows an elevated cross section taken along line B—B of FIG. 2 clearly illustrating the oval configuration of the medial portion of thick handle portion 12. For an easier grip the horizontal or wide portion is greater in dimension by 20–50% than its height or vertical portion.

Figure 4:
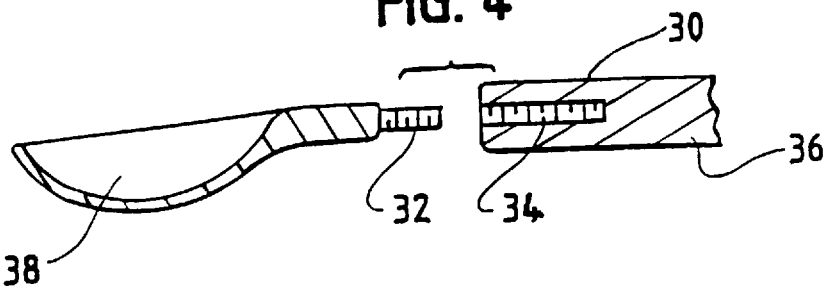
FIG. 4 is an elevated partial cross section with the handle portion unscrewed from the feeding implement portion which was taken along line A—A of FIG. 1.

FIG. 4 shows a partial elevated cross section of a second embodiment of the present invention with a removable handle and feeding implement portions with these portions separated. This cross section is taken from the tip of the spoon bowl to just behind the threaded bore portion of the handle. In this view is shown standard spoon bowl 38 which has a typical depth of 0.4" to approximately 0.6". Also shown, but not in cross section, is threaded bolt fastening element 32 which is adapted to be removably secured within tapered bore 34. Threaded bolt fastening element protrudes from just behind standard spoon bowl 38, while corresponding tapered bore 34 is centrally located at one tip of slim handle portion 36. Again, either the standard spoon bowl 38 and/or the slim handle 36 may be made from plastic or metal, depending on the cost and durability of the final product which is desired. It is further expected that a slim handle 36 would be desired for a child that has adequate grasping skills or to fit into a utensil holder or universal cuff if the impaired child has no ability to grasp. Thicker handles do not generally fit inside utensil holders. In this instance, slim handle 36 is without gripping indentations and so it is expected to be used by a child without hand placement difficulties or to be placed inside a utensil holder.

Figure 5:
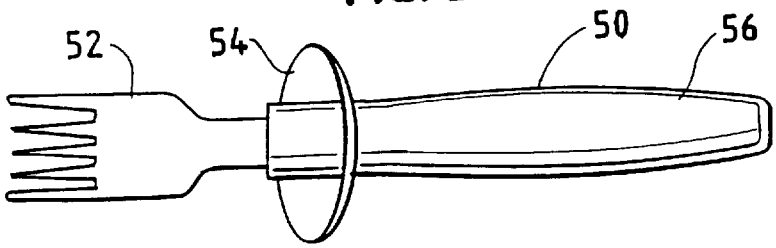
FIG. 5 is a top view of another embodiment of the present invention showing an integral mouth guard, fork tines in the feeding implement portion and a slim handle portion.

FIG. 5 illustrates yet a third embodiment of the present invention in which improved child's feeding implement 50 is shown in top view. Screw on fork tines 52 are removably fastened to slim handle 56. This view shows a straight handle, presumably for the child that is more skilled at turning child's feeding implement 50 into her or his mouth. Further provided in this third embodiment of the present invention is integral mouth guard or shield 54. The integral mouth guard or shield 54 may either be made from a rigid or semi-rigid plastic or other co-polymer for comfort when the feeding implement 50 is placed into the child's mouth. Of course, mouth guard or shield 54 serves a dual purpose in that not only does it prevent the child from placing the feeding implement 50 too far back into her or his mouth, invoking an involuntary choking reflex, but it also promotes proper hand placement on the handle portion of the device.

Figure 6:
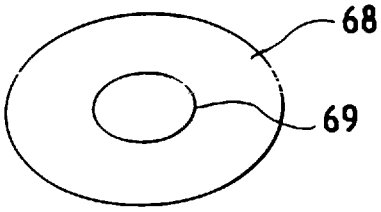
FIG. 6 shows a front view of a removable snap on mouth guard intended for use with the handle portion depicted in FIG. 7.
Figure 7:
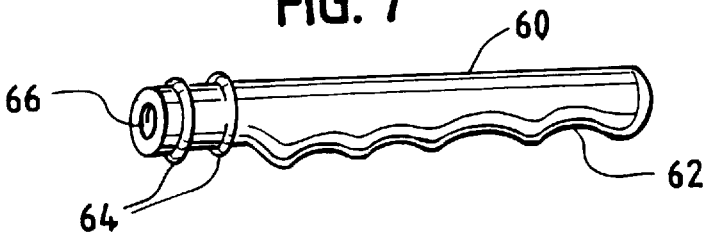
FIG. 7 shows a side view of a bent handle portion equipped with ribs which allow a removable mouth guard to be removably snapped thereon.

FIG. 6 shows a front view yet a fourth version of the present invention featuring removable mouth shield 68 showing an oval hole or aperture 69 which is adapted to fit the corresponding handle shown in FIG. 7 between two annular bumps or protrusions 64. In such a manner, removable mouth shield 68 may snap onto or stretch over handle 62 shown in FIG. 7. Removable mouth shield 68 is preferably made from an elastomeric plastic or rubber composition, or a semi-rigid plastic or other co-polymer which should allow it to either be stretched over annular bump or protrusion 64, or snap on over annular bump or protrusion 64. Further, both integral mouth guard or shield 54 and removable mouth guard 68 may be oval in configuration, wherein the horizontal axis is longer than the vertical axis when the feeding element is properly positioned for placement into the mouth, providing greater efficacy in use.

Figure 8:
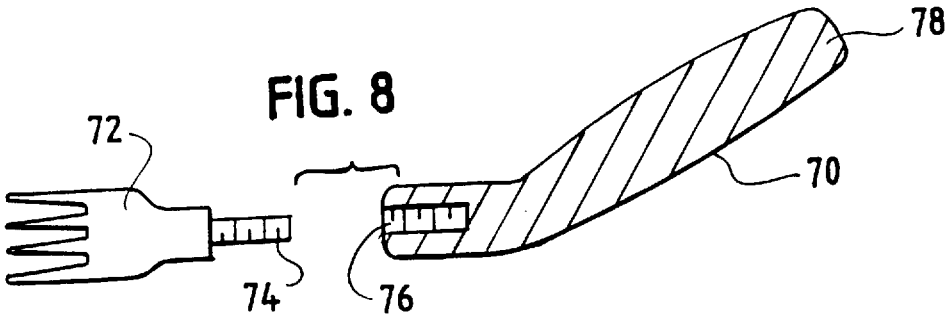
FIG. 8 shows a partial top cross section of another embodiment of the present invention with relatively blunt fork tines, a tapered threaded fastening element and a medium thick handle portion without finger indentations along its distal side.

Finally, FIG. 8 shows a fifth embodiment of the present invention, child's feeding implement 70 which is equipped with handle portion 78 which may be used by left handed children. In this particular version of the instant invention is shown a screw on fork portion 72 with blunt tines for a very young child or an impaired child which may be injured by the standard more tapered fork tines shown in FIG. 5 as screw on fork tines 52. Also shown in this fifth embodiment is a tapered threaded fastening element 74 which extends from screw on blunt fork tines 72 and which is adapted to be removably secured to the tapered threaded bore 76 found at the interior tip of medium handle 70. It is anticipated that a medium handle is expected to be approximately 0.7" to 0.8" at its widest point, for children that have moderate limitations and would benefit from a slightly built up handle.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A feeding implement having:

a handle portion with gripping means and a fastening element;

a feeding element portion with a spoon bowl or fork tines and a corresponding fastening element, and, mouth guard means comprising a flanged annulus extending in diameter at least one half inch from the handle portion of the device, wherein the fastening element of the handle portion may be removably secured to the corresponding fastening element of the feeding element portion.

2. The feeding implement according to claim 1 in which the handle portion of the device has a bend of substantially between ten and seventy degrees from the longitudinal axis of the device.

3. The feeding implement according to claim 2 wherein the feeding element portion is provided with a threaded portion and the handle portion is provided with a tapped aperture.

4. The feeding implement according to claim 1 in which the handle portion has a bottom portion and a distal side portion and it further contains gripping indentations for the purpose of promoting proper hand placement on the handle portion.

5. The feeding implement according to claim 1 in which the handle portion is thickened such that it is substantially greater than one half inch in diameter.

6. The feeding implement according to claim 2 in which at least two handle portions of varying diameters are provided together with at least two feeding implement portions consisting of at least one fork with tines and one spoon bowl.

7. The feeding implement according to claim 1 in which the mouth guard is removably secured to the feeding implement between the feeding element portion and the handle portion.

8. The feeding implement according to claim 4 in which the gripping indentations are provided on the bottom portion of the handle portion.

9. The feeding implement according to claim 4 in which the gripping indentations are present on both the bottom portions and the distal side portions of the handle portions.

10. A feeding implement having:

a handle portion with a bend of substantially between ten and seventy degrees from the longitudinal axis of the device;

a feeding element portion consisting of either a set of fork tines or a spoon bowl;

a built up gripping portion at least substantially one half inch in diameter which conforms to the grip of the user; and, mouth guard means to promote proper grip on the handle portion of the device and to prevent the device from being placed too far back into the mouth of the user, invoking an undesirable choking reflex.

11. A feeding implement having:

a handle portion with gripping means; and, a feeding element portion with a spoon bowl or fork tines; and, mouth guard means positioned between the handle portion and the feeding element portion, wherein there is a bend of substantially between ten and seventy degrees from the longitudinal axis of the device between the handle portion and the feeding element portion.

12. The feeding implement according to claim 11 wherein the mouth guard means comprises an annular flange.

* * * * *